United States Patent [19]

Kober

[11] 3,962,941

[45] June 15, 1976

[54] PRESS FOR PERFORATING AND TRIMMING BOARDS OF FILAMENTARY MATERIAL

[75] Inventor: Harald Kober, Wanne-Eickel, Germany

[73] Assignee: G. Siempelkamp & Co., Wanne-Eickel, Germany

[22] Filed: Feb. 14, 1975

[21] Appl. No.: 550,024

[30] Foreign Application Priority Data

Feb. 15, 1974 Germany ..... 2407260

[52] U.S. Cl. ..... 83/228; 83/157; 83/620

[51] Int. Cl.[2] ..... B26D 5/20

[58] Field of Search ..... 425/290; 83/203, 104, 83/255, 257, 276, 418, 412, 227, 228, 405, 620, 681, 682, 157

[56] References Cited

UNITED STATES PATENTS

| | | | |
|---|---|---|---|
| 1,454,841 | 5/1923 | Allen | 83/228 X |
| 1,510,008 | 9/1924 | Lumb | 83/169 X |
| 2,380,123 | 7/1945 | Smith | 83/620 X |
| 2,818,923 | 1/1958 | Pascuale et al. | 83/228 X |
| 3,229,556 | 1/1966 | Jensen | 83/277 X |

*Primary Examiner*—Othell M. Simpson
*Assistant Examiner*—W. D. Bray
*Attorney, Agent, or Firm*—Karl F. Ross; Herbert Dubno

[57] ABSTRACT

A mat of filamentary material is loaded onto a transport tray formed with an array of holes having a predetermined inside diameter. The transport tray is displaced between an upper and lower platen of a press. The upper press platen is provided with an array of downwardly extending pins having an outside diameter much smaller than the inside diameter of the holes in the transport tray, each pin being alignable with a respective transport-tray hole. The lower press platen is formed with an array of upstanding tubular nipples having an outside diameter smaller than the inside diameter of the transport-tray hole and an inside diameter corresponding to the diameter of the pin. Each nipple is arrayed beneath a respective hole in the transport tray and therefore beneath a respective pin so that as the upper platen descends the pin punches a hole in the mat using the nipple as a die. The upper end of each nipples lies in the plane of the upper surface of the transport tray. In addition a peripheral blade is provided on the upper platen to trim off the edge of the mat as the upper platen is lowered.

10 Claims, 3 Drawing Figures

PRESS FOR PERFORATING AND TRIMMING BOARDS OF FILAMENTARY MATERIAL

CROSS-REFERENCE TO RELATED APPLICATIONS

This application is related to copending and commonly assigned patent applications Serial Nos. 381,435 (now U.S. Pat. No. 3,914,079) and 381,436 both filed July 23, 1973.

FIELD OF THE INVENTION

This invention relates to a system for punching boards of filamentary material. More particularly this invention concerns the production of perforated fiber plates, in particular to those made using asbestos fibers held together by a hydraulic binder such as cement.

BACKGROUND OF THE INVENTION

It is conventional practice to produce peg board, rock lath, and similar perforated plates by pressing a sheet of filamentary material held together by a binder such as hydraulic cement between a pair of platens one of which is provided with an array of pins. Traditionally the mat is carried on a transport tray that is formed with an array of holes having inside diameters corresponding to the outside diameters of the pin array on the upper press platen. The transport tray is exactly positioned under the array of pins so that when the platens are closed the pins pass through the mat and through the tray, therefore producing a hard board having an array of perforations exactly corresponding to the array of pins and holes on the platen and tray.

This arrangement has the considerable disadvantage that it is necessary to control the motion of the transport tray with extreme precision. This is so because it is absolutely essential that the holes in the transport tray, which acts as a multiple dies, are aligned perfectly with the pins on the press platen. Otherwise damage to the press will occur. These transport trays are usually relatively thick metal plates so that if it is desired to change the diameter of the perforations formed in the board it is necessary to replace the plates as well as the pins, a relatively expensive proposition. Thus the necessary control and transport system is very expensive as is changeover to a different type of board.

OBJECTS OF THE INVENTION

It is therefore an object of the present invention to provide an improved system for perforating a board of filamentary material.

Another object is the provision of an improved method of and apparatus for making perforated asbestos-cement plates.

A further object is to provide such a system wherein changeover from one size perforation to another is relatively simple.

Yet another object is the provision of a punching system wherein precise placement of the tray between the press platens is not essential.

SUMMARY OF THE INVENTION

These objects are attained according to the present invention in a system wherein the transport tray is formed with an array of throughgoing holes of predetermined inside diameter which is considerably greater than the outside diameter of the punch pins provided on the upper press platen. The lower press platen however is formed with an array of upwardly opening apertures each of an inside diameter substantially smaller than the holes in the tray and equal to the diameter of the punch pins. Thus the difference between the radii of the holes in the tray and the punch pins corresponds to the maximum possible loading tolerance. The lower platen itself acts as a multiple die or matrix and, since this lower platen always moves precisely relative to the upper platen, proper alignment of the punch pins and die holes is assured.

According to another feature of this invention the lower press platen is provided with an array of short upstanding tubes or collars each formed with a throughgoing passage constituting a die aperture and each having an upper end of outside diameter substantially smaller than the inside diameter of the holes in the tray. In this case the difference between the side diameter of each such tube and the inside diameter of each hole constitutes the maximum possible loading tolerance. Each of these tubes has an upper end adapted to lie in the same plane as the upper surface of the loading tray when this loading tray is resting on the lower press platen. This prevents excessive extrusion of the filamentary material through the tray at the space between the tubes and the holes.

The apertures or passages in the lower platen according to the present invention taper upwardly, that is they are narrower at their upper ends than at their lower ends. This formation prevents the clogging of these passages with plugs of punched-out filamentary material. The use of such tubes allows ready replacement of a single damaged die tube, or replacement of all of the die tubes should it be desirable to change perforation diameter. A skilled worker can readily unscrew or simply withdraw the various die tubes and punch pin in order to allow differently dimensioned perforations to be made.

According to the present invention the loading tray, forming one of a succession of loading trays on an endless coveyor chain passing between the platens, is formed of rigid perforated metallic plate having a planar upper surface adapted to receive the mat and a planar lower surface above the planar upper surface of the lower platen. Each tube has an overall height above the lower platen equal to the height of the spacer rails plus the thickness of the plate.

The upper platen in accordance with the present invention is formed with downwardly tapering centering pins which engage in correspondingly dimensioned holes in the transport tray and the lower platen so as to ensure accurate alignment of the pins, tubes and holes.

With the apparatus according to the present invention it is possible to work at a relatively high speed, because the transport trays need not be positioned with great precision between the press platens. In addition it is a relatively simple operation to free the finish-pressed board from its transport tray. A common problem of the prior art system is that the filamentary material is extruded through the holes in the transport tray making it hard to separate them. This in not a problem with the arrangement of this invention as the transport tray, when lifted off the lower platen, pulls the board free at the region of the tray holes.

BRIEF DESCRIPTION OF THE DRAWING

The above and other objects, features, and advantages will become more readily apparent from the following description, reference being made to the accompanying drawing in which.

SPECIFIC DESCRIPTION

The apparatus according to the present invention comprises a press indicated generally at 1 for punching perforated boards 2 from mat 3 and employing a loading arrangement 4' and an unloading arrangement 4'' as described in the latter of the above-mentioned copending applications.

Figure 2:
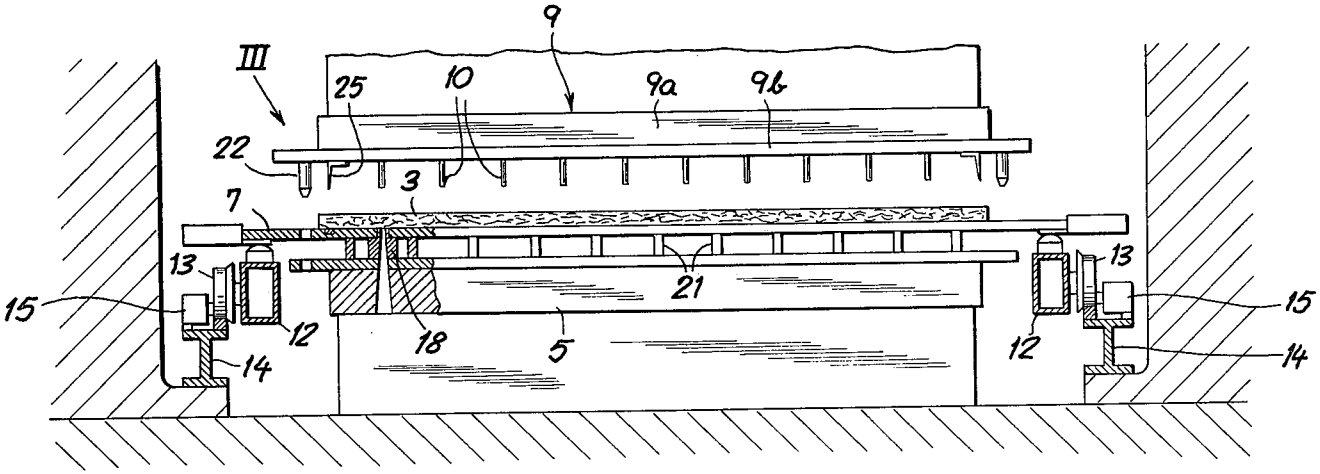
FIG. 2 is a vertical section taken through the press of FIG. 1 in enlarged scale.
Figure 3:
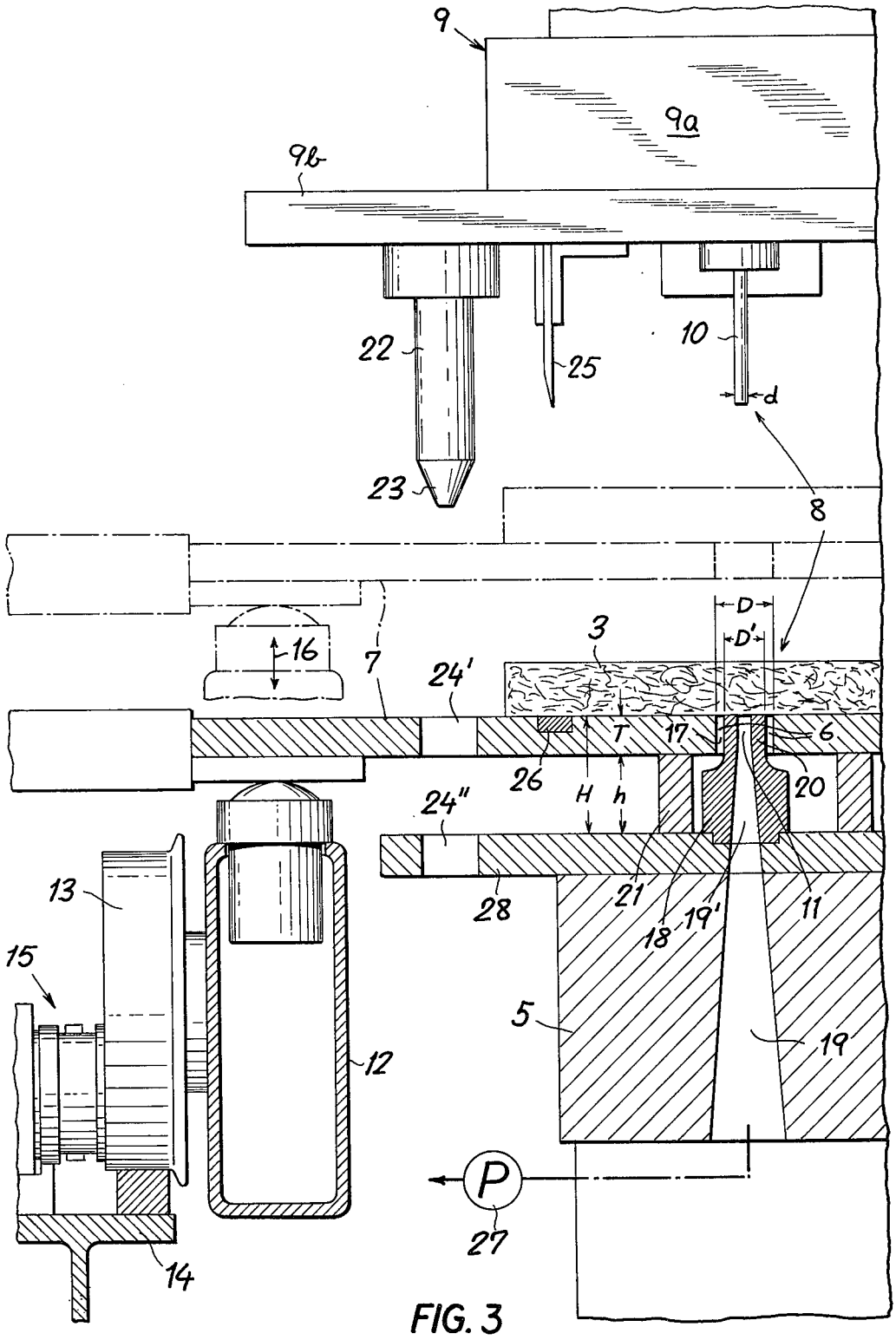
FIG. 3 is a large-scale view of the detail indicated by arrow III of FIG. 2.

As shown in more detail in FIGS. 2 and 3 the press 1 has a lower platen 5 adapted to receive, one at a time, trays 7 supporting the unperforated and trimmed mats 3. The press 1 also has an upper platen 9 and a plurality of means 8 is provided for punching an array of holes in the mat 3.

Each of the means 8 comprises a pin 10 carried on a plate **9*b* removably secured to the upper portion 9*a* of the upper platen 9. Each pin 10** has an outer diameter *d.*

Figure 1:
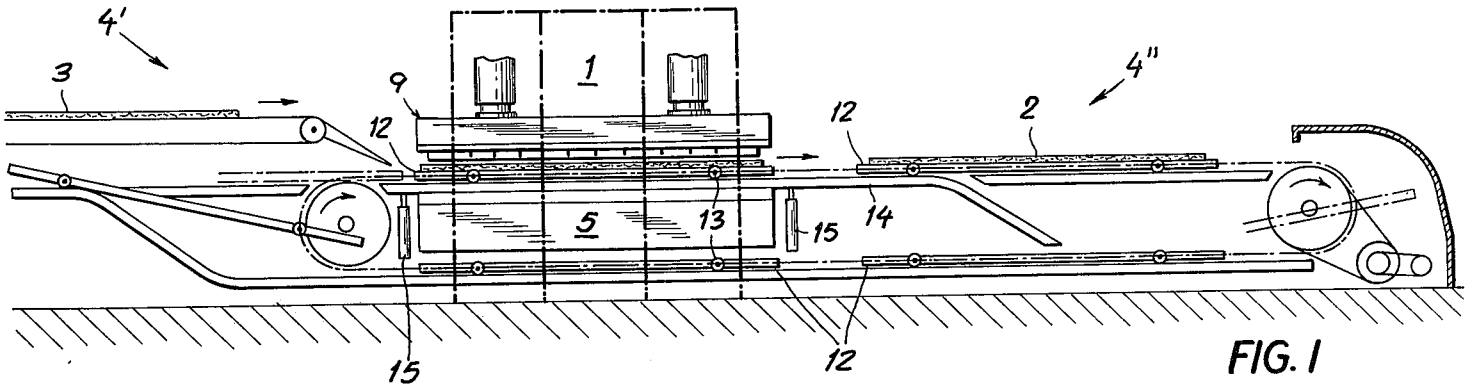
FIG. 1 is a side partly sectional and diagrammatic view illustrating the system according to the present invention.

The lower platen 5 is formed with an array of downwardly flaring passages 19 connected to a pump 27 that serves to withdraw liquid (expressed from the mixture of hydraulic binder and fiber forming the mat) from between the platens 5 and 9. Each of these passages terminates at its upper end at a hole 11 having an inner diameter substantially equal to the outer diameter *d* of the pins 10. Each of the holes 11 is directly in line with a respective pin 10. As shown at 12 the trays may be interconnected as an endless chain shown in the dot-dash lines in FIG. 1.

Each tray 7 is formed with an array of circular holes 17 each having an inner diameter D and in line with a respective pin 10 and hole 11. In addition the lower platen 5 is provided with a plate 28 on which is mounted a plurality of short upstanding tubes 18 formed with the holes 11 and with passages 19' in line with the passages 19. Each of these short tubes 18 has an overall height H above the upper surface of the plate 28 and each has an outer diameter at its upper end equal to D' which is smaller than the diameter D by a radial spacing 6. The tolerance 6 with which the transport system delivers the trays 7 to the platen 5 is equal to the distance 6 at most so that in all cases the holes 17 will merely be fit over the upper ends 20 of the tubes 18. To this end the trays are supported on rails 12 by rollers 13 that run thereon on other guide rails 14. Devices 15 are provided to displace the beams 12 in the direction shown in FIG. 3 by arrow 16 so as to raise and lower the respective tray down and over the tubes 18. Diameter D is equal to between 5 and 7 times diameter *d.*

The tray 7 is provided on its lower planar face with spacer rails 21 having a height *h* that together with the thickness T of the plate 7 is equal to the height H of the nipples 18. Thus the upper ends 20 of the nipples 18 lies exactly at the upper planar surface of the tray 7.

In addition the upper platen 9 is provided at its plate **9*b* with trimming blades 25 whose cutting edges are engageable against lead anvil strips 26 inset in the tray 7. Thus as the platen 9 descends not only will pins 10 punch a regular array of holes through the mat 3, but blades 25 will trim its edges all around. This plate 9*b* is also provided with downwardly directed cylindrical pins 22 having frustoconically downwardly tapered ends 23 that engage through holes 24' in the trays 7 and 24'' in the plate 28 carried on the platen 5. The pins 22 are substantially longer than the pins 8 so that the pins 22 align the tray 7 and lower platen plate 28 before the pins 10 engage the mat 3.**

In order to change perforation diameter it is possible to replace plate **9*b* with another plate having differently sized pins 10 and even differently set blades 25. The plate 28 may similarly be replaced or the nipples 18** alone may be switched for others of different inside diameters.

OPERATION

A mat 3 (FIG. 1) of hydraulic binder and fiber is carried by a conveyor arrangement 4' toward the press 1 and is deposited upon one of the trays 7 linked together at 12 into an endless chain passing about the terminal rollers as shown in this Figure.

As the tray 7 enters the press 1 lowered from the dot-dash position shown in FIG. 3 into the solid line position of this Figure, the nipples 18 enter the perforations or apertures 17 of the tray. The upper press platen 9 is then lowered, causing the positioning pin 22 to engage the aperture 24' and shift the tray, if necessary, to bring about accurate alignment of the tray with the upper and lower platens. As the upper platen 9 continues to descend, the pins 10 punch perforations in the mat and drive the plugs out of the bore 11 of the respective nipples. Simultaneously, the blade 25 trims the edges of the mat.

The upper platen 9 is then withdrawn upwardly to disengage the mat, whereupon the tray is lifted to its dot-dash position (3) to clear the nipples 18 and is displaced out of the press.

I claim:

1. A system for punching boards of filamentary material, said system comprising:

a transport tray carrying a sheet of filamentary material and formed with an array of throughgoing holes of predetermined inside diameter, said tray having an upper and lower surface;

a lower press platen receiving said tray carrying said sheet and formed with an array of upwardly opening apertures each of an inside diameter substantially smaller than said holes and registering with a respective hole of said array of throughgoing holes;

an upper press platen above said lower platen and provided with an array of punch pins each in line with a respective aperture and each of an outside diameter corresponding substantially to the diameter of said apertures; and means for relatively displacing said platens together for pressing said pins through said sheet, through said holes, and into said apertures for perforating said sheet.

2. The system defined in claim 1 wherein said lower platen is provided with an array of die elements each forming one of said apertures.

3. The system defined in claim 2 wherein said elements each have an upper end projecting into a respective hole in said tray and terminating at the level of the upper surface of said tray.

4. The system defined in claim 3 wherein said upper ends have outside diameters substantially smaller than said inner diameter of said holes.

5. The system defined in claim 4 wherein said tray includes a metal plate having said upper surface and a plurality of rigid spacer rails fixed under said plate and spaced to lie between said elements.

6. The system defined in claim 5 wherein said lower platen has a top surface and said elements project above said top surface by a vertical distance equal to the overall vertical thickness of said plate and rails of said tray.

7. The system defined in claim 4 wherein said tray is formed outside said array of holes with at least one centering hole, said upper platen being provided with a downwardly directed centering rod engageable in said centering hole.

8. The system defined in claim 7 wherein said centering rod and said centering hole are of substantially the same diameter, said centering rod having a pointed end.

9. The apparatus defined in claim 2, further comprising means for advancing a succession of such trays between said platens.

10. The apparatus defined in claim 9 wherein said trays are interconnected as an endless chain.

* * * * *